US009476153B2

(12) United States Patent
Lagogiannis

(10) Patent No.: US 9,476,153 B2
(45) Date of Patent: Oct. 25, 2016

(54) KNITTING SPIRALITY STABILIZER

(71) Applicant: Georgios Lagogiannis, Salonika (GR)

(72) Inventor: Georgios Lagogiannis, Salonika (GR)

( * ) Notice: Subject to any disclaimer, the term of this patent is extended or adjusted under 35 U.S.C. 154(b) by 0 days.

(21) Appl. No.: 14/786,166

(22) PCT Filed: Jul. 17, 2014

(86) PCT No.: PCT/GR2014/000040

§ 371 (c)(1),
(2) Date: Jan. 7, 2016

(87) PCT Pub. No.: WO2015/008098

PCT Pub. Date: Jan. 22, 2015

(65) Prior Publication Data

US 2016/0130737 A1 May 12, 2016

(30) Foreign Application Priority Data

Jul. 18, 2013 (GR) ..... 20130100423

(51) Int. Cl.
*D06C 5/00* (2006.01)
*D06B 23/08* (2006.01)

(52) U.S. Cl.
CPC ..... *D06C 5/00* (2013.01); *D06B 23/08* (2013.01)

(58) Field of Classification Search
CPC ..... D06C 5/00; D06C 5/005; D06C 3/06; D06C 3/08; D06C 2700/10; D06B 23/08; D06F 59/00; D06F 73/00; D04B 15/88
USPC ..... 26/83, 80, 81, 84, 85, 51, 51.3; 66/152, 66/149 R, 150, 153; 57/1 UN
See application file for complete search history.

(56) References Cited

U.S. PATENT DOCUMENTS 625,169 A * 5/1899 Johnston ..... D06C 5/00 26/81
2,750,649 A * 6/1956 Johnson ..... D06C 5/00 26/81
3,337,107 A * 8/1967 Catallo ..... D06C 5/00 226/196.1
3,978,557 A 9/1976 Goodson
4,269,046 A * 5/1981 Strahm ..... D06C 5/00 26/85

(Continued)

FOREIGN PATENT DOCUMENTS

EP 1136611 A2 9/2001
GB 802750 A * 10/1958

(Continued)

*Primary Examiner* — Amy Vanatta
(74) *Attorney, Agent, or Firm* — Kintner IP, LLC; Mary Frances Ludwig

(57) ABSTRACT

The knitting spirality stabilizer is constituted of a frame (1) and a circle pattern constituted of one fixed ring (2) and one movable ring (3). A layout circumferentially located on the movable ring regulates the operation diameter according to the fabric. The layout includes external rests (4), which can be height regulated and position stabilized using external pins (6). External magnets (7) are located on the external rests. Turn wheels (10) on the external rests enable smooth fabric rolling without wears. Internal mechanism (9) is positioned inside the frame and constituted of foldable frame (11) and internal pins (16) for the initial placement. Internal rests (12) on the foldable frame correspond to the external rests, and have their own respective turn wheels (10) and internal magnets (8). Internal and external magnets have opposite polarity to create a magnetic field. Flexible bands (13) are used as drivers during the fabric passage.

9 Claims, 5 Drawing Sheets

(56) References Cited

U.S. PATENT DOCUMENTS

| | | | | | |
|---|---|---|---|---|---|
| 4,306,340 | A | | 12/1981 | Strudel et al. | |
| 4,608,767 | A | * | 9/1986 | Dornier | D06C 5/00 26/81 |
| 5,442,842 | A | | 8/1995 | Nielsen et al. | |
| 5,519,922 | A | * | 5/1996 | Strudel | D06B 15/025 26/84 |
| 5,575,162 | A | * | 11/1996 | Gray | D04B 15/88 66/149 R |
| 5,666,704 | A | * | 9/1997 | Price | D06B 3/08 26/51 |
| 5,884,377 | A | * | 3/1999 | Rutz | D06B 15/025 26/80 |
| 6,601,412 | B1 | * | 8/2003 | Quay | D04B 15/88 66/149 R |
| 6,615,462 | B2 | * | 9/2003 | Strudel | D06C 5/00 26/80 |
| 2002/0129473 | A1 | * | 9/2002 | Labude | D06C 5/00 26/80 |
| 2013/0074297 | A1 | * | 3/2013 | Dey | D06C 5/00 26/80 |

FOREIGN PATENT DOCUMENTS

| | | | |
|---|---|---|---|
| WO | WO 97/40222 | * | 10/1997 |
| WO | 2008/148574 A1 | | 12/2008 |

* cited by examiner

KNITTING SPIRALITY STABILIZER

CROSS REFERENCE TO RELATED APPLICATIONS

This application is a national stage filing of International Patent Application No. PCT/GR2014/000040 filed 17 Jul. 2014, which claims priority to Greek Patent Application No. 20130100423 filed 18 Jul. 2013, each of which is hereby incorporated by reference in its entirety.

TECHNICAL FIELD

The present invention pertains generally to textile processing and more particularly to an apparatus for stabilizing spirality of stitched seams.

BACKGROUND OF THE INVENTION

The invention relates to an apparatus for processing tubular fabric, in its final stage of processing (textile finishing) before going to garment manufacturing units to become a ready to use product (t-shirts, trousers, dresses, etc.). The invention is used in the final line processing (finishing) of fabric, where it goes after the dye on dyeing machines and before cutting into pieces that go on to be sewed according to the garment design.

Until recently the reduction of spirality effect on the fabric, which leads to displacement of the seams on finished fabrics (such as t-shirts, trousers, etc.) that is observed after washing and drying, was achieved by using various types of machinery that perform under the principle of "rollers move fabric". However, the anticipated result of minimizing the spirality of the knitting was not achieved because the circular cross-section of the fabric produced by the circular knitting machine does not allow any additional management or accurate control of fabric spirality.

The problems that occurred by the erroneous management of fabric were mainly failures in the final result, with the final levels of remaining spirality being above the generally acceptable level of 4-6%. As an example, it was a frequent phenomenon during the wash of a t-shirt to have displacement of seams (B) from their initial place (A) (see FIG. 5), resulting in the production of defective products. These defects occur because the fabric was produced by a circular knitting machine, but furthermore because fabric is being stressed during the dyeing process in the dying machines and during the finishing stage after the dying process. Consequently, the result of the production process and fabric processing is the creation of a knitting spirality effect, so that the seams and the design of the garments are being displaced.

BRIEF SUMMARY OF THE INVENTION

The application of the present invention is to decrease and accurately stabilize, within generally acceptable levels, the spirality of tubular knitted fabric. Spirality errors occur mainly because of the working way of knitting in circular knitting machines, but also because of the spirality of fabric during its processing at dyeing and finishing stages. The present invention solves the problem of fabric management in such a way that the spirality of knitting returns to within the desirable limits of 4-6%.

The advantage of this invention is the external transmission of rotation, with the use of a removable internal mechanism (removable capsule), which is placed in the interior of an external mechanism, and concentric with an exterior ring. The internal mechanism is retained in its place by the magnetic field created by the opposite polarities of permanent magnets located both on the external mechanism and on the internal mechanism. These magnets create the traction power that retains the internal mechanism in its place. After the internal mechanism is placed, fabric passes between the internal and external mechanisms, in such a way that the internal mechanism is found in the internal diameter of the fabric. Henceforth the fabric is retained between the internal mechanism and the external mechanism, and therefore can be turned depending on the movement of a movable ring of the external mechanism. The direction and speed of motion is suitable to achieve fabric passage without wears and rebound of fabric spirality to within the desirable limits.

DETAILED DESCRIPTION OF THE INVENTION

The fabric management with the use of this invention is particularly simple. First the operator has to calculate spirality with a simple test. In order to calculate the initial fabric spirality, the operator uses a piece of fabric. He creates on the piece of fabric, with a marker pen, a rectangular geometric drawing or a cross. Afterwards, he does the wash and the dry of the piece of fabric. By measuring the vertical divergence of geometric drawing or cross and with reduction in one hundred meters length of fabric, he calculates the knitting spirality as a percentage. Then the fabric, according to its internal diameter, is placed in the machine. Before that the mechanism regulation with the required diameter must be performed. Then the operator passes the fabric between the external and the internal mechanism (between the rollers that each mechanism allocates for this reason). After the fabric placement, operator by using a touch screen, inputs the essential data (fabric width, direction of rotation and percent rate of spirality that resulted from the previous test). The whole machine operation is fully automated with the use of a Programmable Logic Controller (PLC) based on the data that have been inputted by the use of a touch screen. Rotational motion of the external mechanism is driven via a belt drive through a system of an electric motor with a reduction gear controlled by an inverter. The rotation of the movable ring of the external mechanism transmits the motion in a magnetic way to the internal mechanism (capsule) that is found in the inner side of the tubular knitted fabric and which moves the tubular knitted fabric in such a way as to minimize the spirality effect. The removable capsule is turned together with the movable ring because of the opposing magnetic fields between the two mechanisms, which forces the capsule to turn without slipping. Simultaneously, the fabric is moving longitudinally because of the operation of a finishing machine that follows the spirality stabilizer (such as a compactor, calendar, or tubular heat setting). The finishing machine delivers the fabric in order to give its final form (e.g., the suitable weight and the appropriate surface finish of the fabric). The finishing machine also stabilizes the spirality correction made by the spirality stabilizer, for example by using steam, heat, pressure, or other means necessary to have permanent effects on the fabric.

The knitting spirality stabilizer according to the present invention is constituted of a) the main body of the machine that drives the rotational motion and b) the internal mechanism, or capsule, which is removable for fabric placement.

Figure 1:
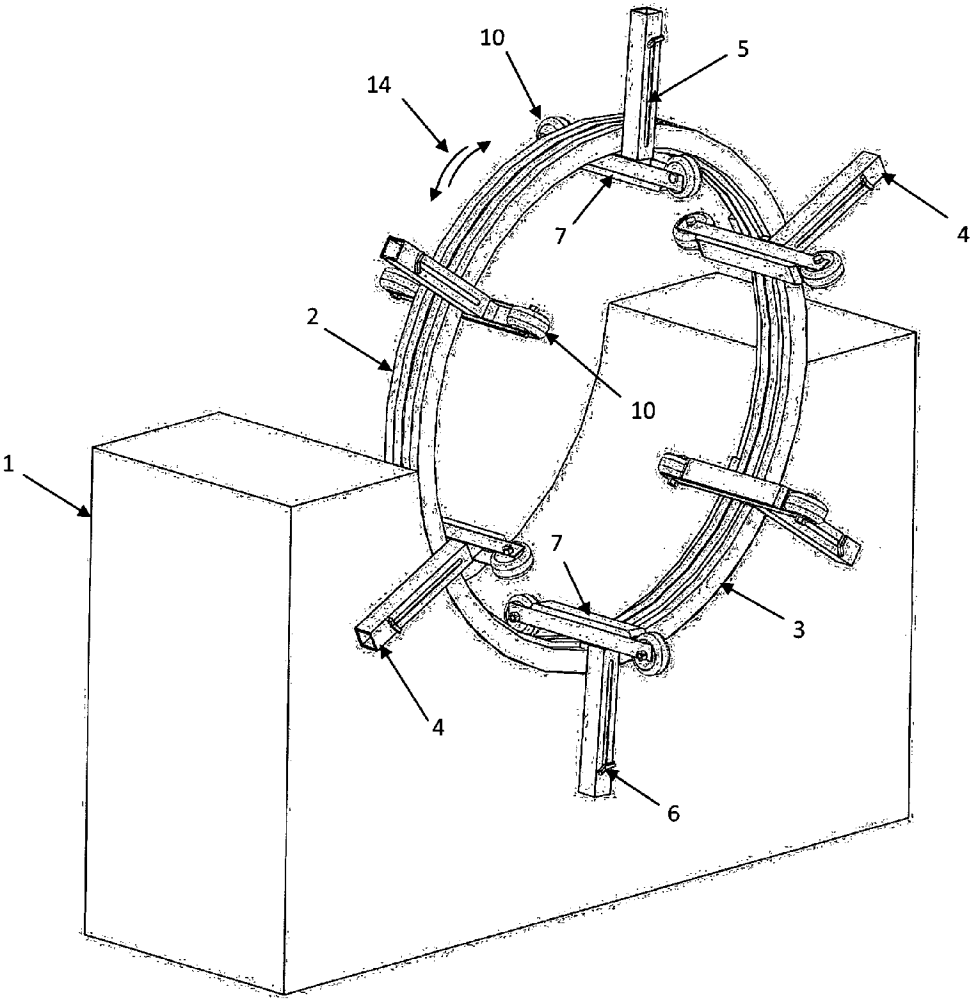
FIG. 1 is a perspective view of a main body of a spirality stabilizer.
Figure 2:
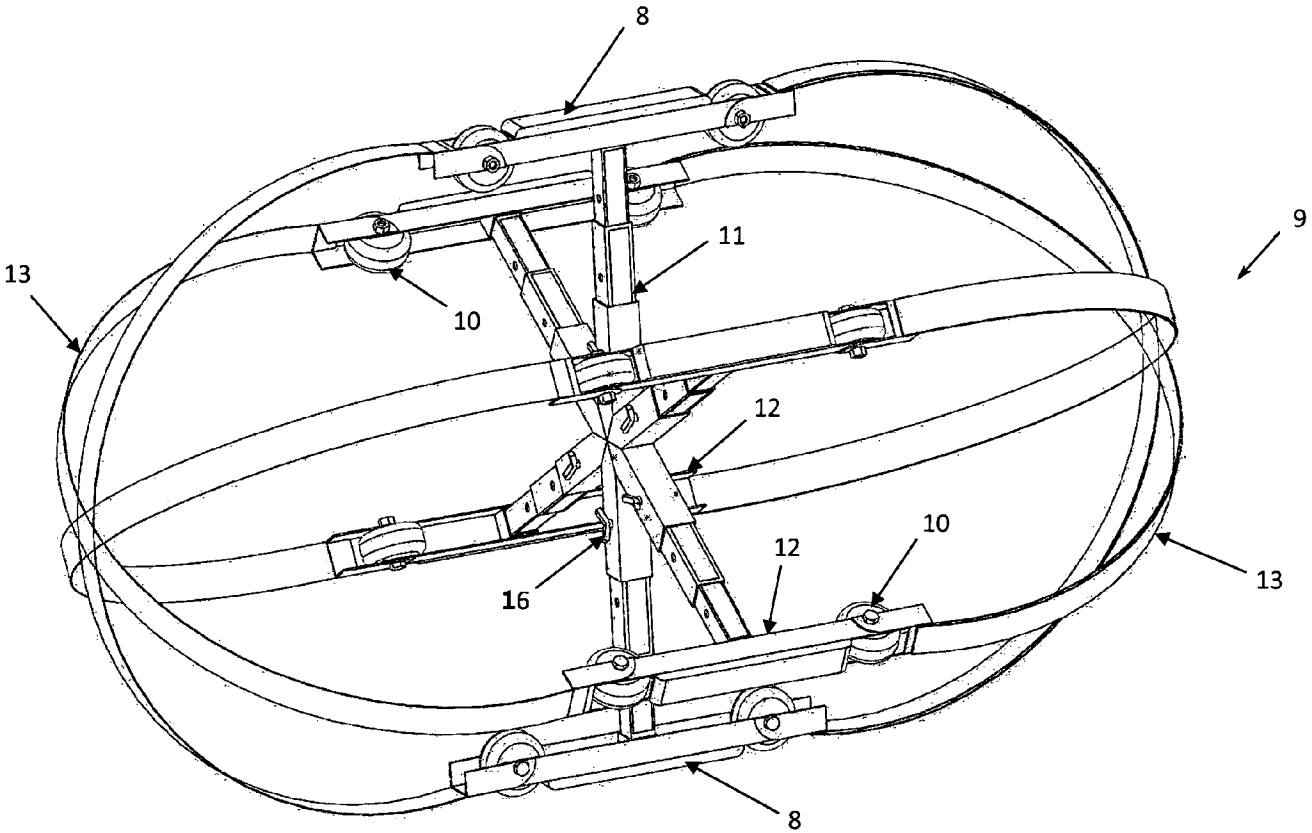
FIG. 2 is a perspective view of an internal mechanism of the spirality stabilizer.
Figure 3:
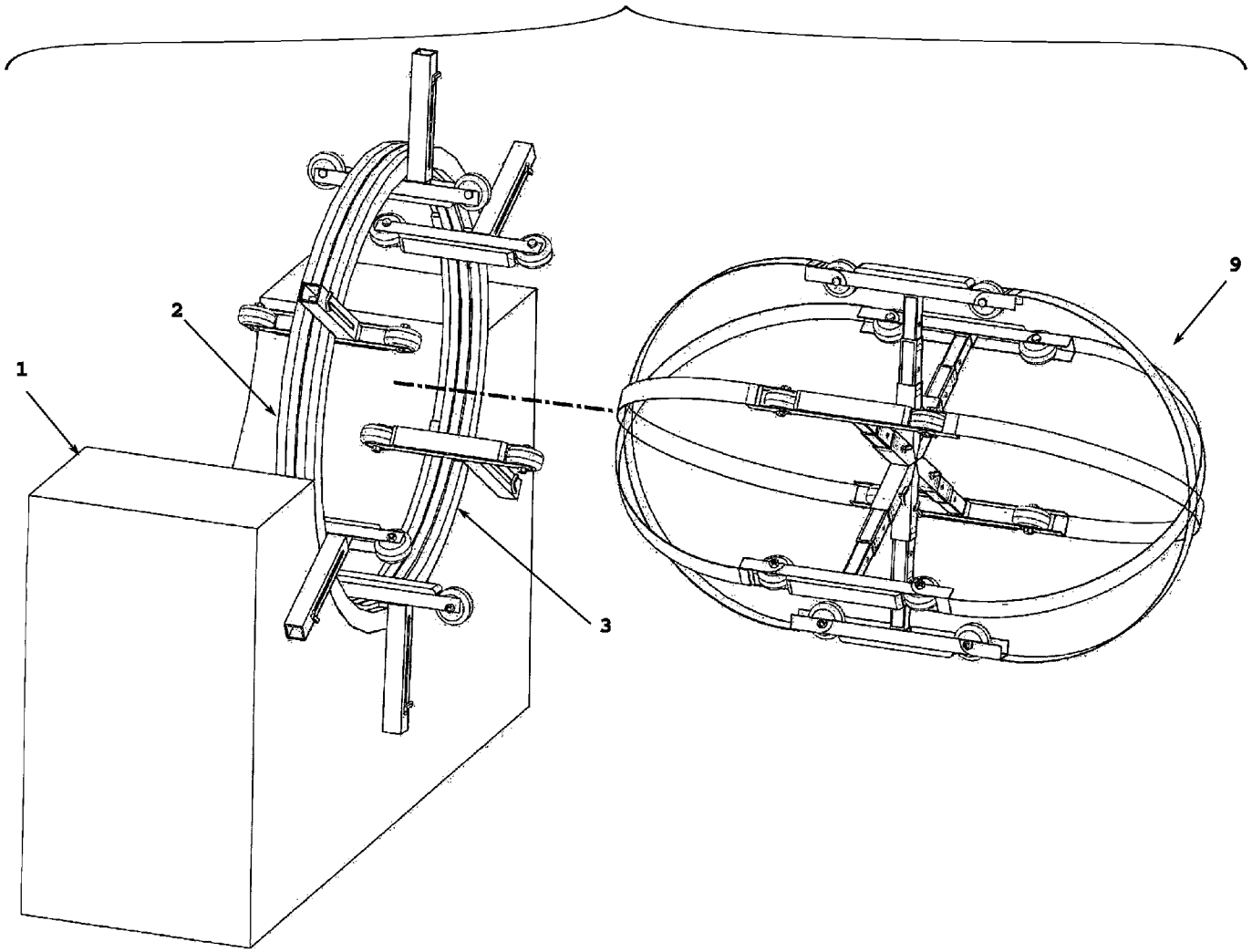
FIG. 3 is an exploded perspective view of the spirality stabilizer.
Figure 4:
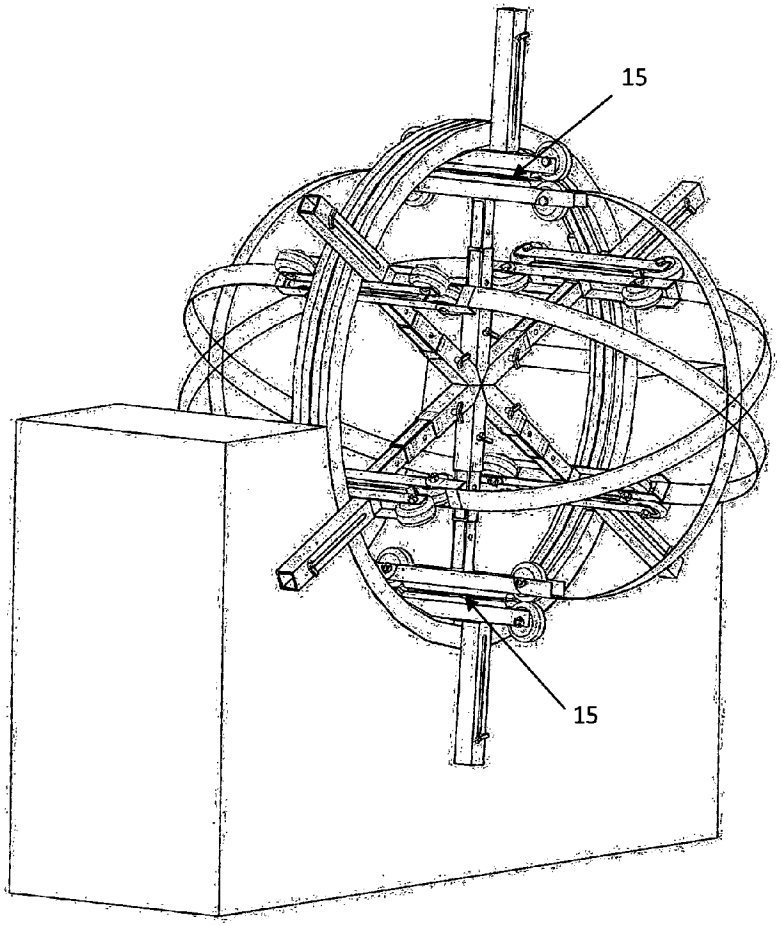
FIG. 4 is an assembled perspective view of the spirality stabilizer.
Figure 5:
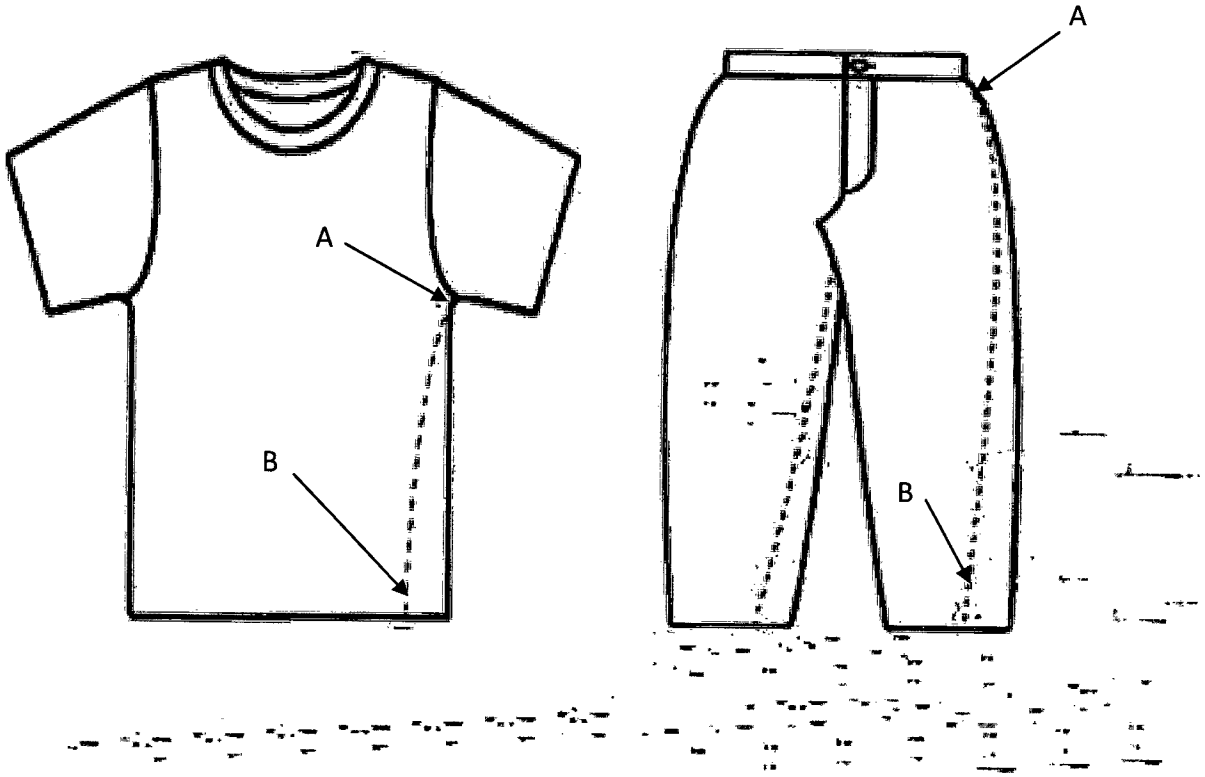
FIG. 5 illustrates the problem of knitting spirality.

The invention is presented in the following drawings. In FIG. 1 is portrayed the main body of the spirality stabilizer, in FIG. 2 is portrayed the internal mechanism of the spirality stabilizer, in FIG. 3 is portrayed an exploded view showing internal mechanism placement in the spirality stabilizer, and in FIG. 4 is portrayed the spirality stabilizer in its assembled state.

The main body of the spirality stabilizer is constituted of the frame (1) in which is placed a circle pattern constituted of two rings, one fixed ring (2) and one movable ring (3). Circumferentially and symmetrically about the movable ring (3) has been placed a layout that regulates the operation diameter according to the fabric. The layout is constituted of independent external rests (4), which can be height regulated (5) and can be stabilized in the desirable location by using external pins (6). The number of rests is even and rests are always placed in diametrically opposing locations. External magnets (7) are located along the innermost surface of external rests (4). External magnets (7) are covered with polytetrafluoroethylene (PTFE). The PTFE covering is used to avoid fabric friction due to longitudinal movement of the fabric because of the operation of the finishing machine that follows the spirality stabilizer. These external magnets (7) in combination with the internal magnets (8) that exist on the internal mechanism (or removable capsule) (9) create a magnetic field by having opposite polarities. The resulting traction force transmits the rotary motion (14) of movable ring (3) to internal mechanism (9). Turn wheels (10) exist both on the internal mechanism (9) and on external rests (4). The internally and externally located turn wheels (10) are in contact and are aligned because of the force and the appropriate placement of magnets(7) and (8). The uniform passage of fabric without contacting the mechanisms simultaneously with the rotation of movable ring (3) is made possible by the opposite polarity magnets and turn wheels, and enables the correction of spirality within the desirable limits.

The turn wheels (10) are manufactured from suitable material so that smooth fabric rolling can be performed without leaving any marks on the fabric and without creating wears on the fabric. The internal mechanism (9) is constituted of a foldable frame (11) giving the possibility to regulate the desirable diameter of operation. The stabilization of internal mechanism (9) is achieved by the magnetic field that is created, which ensures the alignment of turn wheels (10) that roll the fabric during the rotation. Internal pins (16) are used only at the initial placement of internal mechanism (9) for its concentric placement within movable ring (3). In operation, the external mechanism is opened to its widest position, then the internal mechanism is placed into the external mechanism so that is concentric with movable ring (3), and after that internal pins (16) are removed.

On the ends of the foldable frame (11), internal rests (12) have been placed in locations that correspond to those of the external rests (4) when the stabilizer is assembled. Internal rests (12) have their own respective turn wheels (10) with coating made from soft material so that smooth fabric rolling is performed without wear. At the same time internal magnets (8) have been placed which have been covered with PTFE in order to avoid fabric wear. In combination with the external magnets (7) that are placed on the external movable ring (3), they create a magnetic field, so that the turn wheels being aligned and creates the essential gap (15) for the smooth fabric passage. Finally, on the internal mechanism (removable capsule) (9) flexible metal bands (13) have been placed that are used as drivers during the fabric passage and simultaneously facilitate the passage of holes that regularly exist on the fabric, avoiding in this way the danger of fabric being hooked in the mechanism. Metal bands (13) have PTFE coating to avoid fabric wears.

From all those mentioned before as well as from the drawings it is turned out that is a simple, innovative and pioneering manufacture that comes to cover the need for the regulation of knitting spirality, improving the final product, minimizing defective products and save financial resources and time.

The invention claimed is:

1. A knitting spirality stabilizer for processing a tubular fabric having an internal fabric diameter, the spirality stabilizer cooperating with a finishing machine, the spirality stabilizer comprising:

a circular pattern of two rings, one of the rings being a movable ring;

the circular pattern having a circumferentially located layout for regulating an inner diameter of the movable ring, the layout constituted of a plurality of independent external rests, which are height adjustable, external pins for stabilizing the external rests in the desired positions, turn wheels located on the external rests, the turn wheels having a soft material coating made of polytetrafluoroethylene, and external magnets located on the external rests;

an internal mechanism that is received within the inner diameter of the movable ring; and, the internal mechanism having a foldable frame including flexible metal bands, internal pins for maintaining the position of the frame, turn wheels having a soft material coating, and internal magnets for the creation of a magnetic field which provides a traction force that rotates the internal mechanism with the movable ring;

so that the internal mechanism will be received within the inner diameter of the movable ring, the foldable frame and the external rests will be adjusted to positions appropriate for the internal fabric diameter, the tubular fabric will be passed between the internal mechanism and the external ring, and the tubular fabric will be moved longitudinally through the spirality stabilizer by the finishing machine and simultaneously rotated by the motion of the movable ring and internal mechanism, thereby keeping fabric spirality within desirable limits.

2. The knitting spirality stabilizer according to claim 1, further characterized by the two rings of the circular pattern including one fixed ring and one movable ring, and, in which motion is transmitted to the movable ring by a transmission belt operatively connected therewith, the transmission belt being driven by an electric motor operatively connected to a reduction gear and controlled by an inverter.

3. The knitting spirality stabilizer according to claim 1, further characterized by:

the layout for regulating the inner diameter being located on the movable ring;

an even number of the independent external rests, the external rests being in diametrically opposing locations;

the turn wheels located on the external rests aligning with the turn wheels located on the bands and creating a gap for passage of the fabric; and, the external magnets being coated with polytetrafluoroethylene and transmitting the rotary motion of the movable ring to the internal mechanism.

4. The knitting spirality stabilizer according to claim 1, further characterized by:

the foldable frame of the internal mechanism having independent internal rests including a vertical segment on which are located the turn wheels which are capable of rolling;

the turn wheels creating a gap for passage of the fabric;

the internal magnets being polytetrafluoroethylene coated, located adjacent to the turn wheels, and positionable opposite the external magnets of the movable ring, thus creating the desirable traction force for rotary motion of the internal mechanism.

5. The knitting spirality stabilizer according to claim 1, further characterized by the external magnets on the external rests of the movable ring and the internal magnets of the internal mechanism having opposing polarities for the creation of the required force for rotation of the internal mechanism and simultaneously for the alignment of the turn wheels.

6. The knitting spirality stabilizer according to claim 1, further characterized by the flexible metal bands having a polytetrafluoroethylene coating for routing the fabric without the risk of being hooked in the internal mechanism.

7. The knitting spirality stabilizer according to claim 1, further characterized by the turn wheels on the external rests and the turn wheels of the internal mechanism being capable of rolling.

8. The knitting spirality stabilizer according to claim 3, further characterized by the external magnets on the external rests of the movable ring and the internal magnets of the internal mechanism having opposing polarities for the creation of the required force for rotation of the internal mechanism and simultaneously for the alignment of the turn wheels.

9. The knitting spirality stabilizer according to claim 4, further characterized by the external magnets on the external rests of the movable ring and the internal magnets of the internal mechanism having opposing polarities for the creation of the required force for rotation of the internal mechanism and simultaneously for the alignment of the turn wheels.

* * * * *